US005779599A

United States Patent [19]

Chen

[11] Patent Number: 5,779,599

[45] Date of Patent: Jul. 14, 1998

[54] STATIONARY EXERCISER

[76] Inventor: Paul Chen, 5F., No. 31, Gan Tzou 2nd Street, Shi Tun Chu, Taichung, Taiwan

[21] Appl. No.: 914,814

[22] Filed: Aug. 19, 1997

[51] Int. Cl.[6] ..... A63B 69/16; A63B 22/04

[52] U.S. Cl. ..... 482/57; 482/51; 482/70

[58] Field of Search ..... 482/51, 52, 53, 482/57, 70, 79, 80, 148

[56] References Cited

U.S. PATENT DOCUMENTS 5,352,169 10/1994 Eschenbach ..... 482/57
5,383,829 1/1995 Miller ..... 482/57
5,518,473 5/1996 Miller ..... 482/57
5,540,637 7/1996 Rodgers, Jr. ..... 482/51
5,562,574 10/1996 Miller ..... 482/52

*Primary Examiner*—Stephen R. Crow

[57] ABSTRACT

An exerciser includes a pair of levers and a pair of cranks pivotally secured on a base and a pair of links pivotally coupled between the levers and the cranks. A pair of beams are slidably supported beside the links for supporting a pair of foot supports and are pivotally secured to the levers by a pair of extensions for allowing the beams to be adjusted relative to the links. A resistance device includes a weight rotatably supported on the base and coupled to the cranks by a belt for allowing the weight to apply a resistance force against the foot supports.

6 Claims, 3 Drawing Sheets

STATIONARY EXERCISER

BACKGROUND OF THE INVENTION

1. Field of the Invention

The present invention relates to an exerciser, and more particularly to a stationary exerciser.

2. Description of the Prior Art

Typical stationary exercisers comprise a pair of foot pedals each having one or more wheels rotatably or slidably engaged with one or more tracks for allowing the foot pedals to move both upward and downward and forward and backward movements. U.S. Pat. Nos. 5,352,169 to Eschenbach and 5,383,829 to Miller disclose this type of stationary exercisers. The tracks are stably disposed on the ground for supporting the wheels.

The present invention has arisen to provide a novel exercisers.

SUMMARY OF THE INVENTION

The primary objective of the present invention is to provide a stationary exerciser including a pair of foot supports that may be moved forward and rearward relative to a primary driving mechanism.

In accordance with one aspect of the invention, there is provided an exerciser comprising a base including a rear axle and a front axle, a pair of levers pivotally coupled to the front axle for allowing the levers to be swung about the front axle, a pair of cranks rotatably secured to the rear axle, a pair of links including a front portion pivotally secured to the levers and including a rear portion pivotally coupled to the cranks, a pair of foot supports supported beside the links, means for moving the foot supports and the beams relative to the links, and means for applying a resistance force against the foot supports.

The levers each includes a middle portion and a lower portion, the front portions of the links each is pivotally secured to the middle portion of the lever at a pivot pin, the exerciser further includes a pair of beams each having a front portion pivotally secured to the lower portion of the lever at a pivot shaft, the foot supports are secured on the beams, the pivot pins are disposed between the front axle and the pivot shaft for allowing the pivot shafts to swing for a greater amplitude than that of the pivot pins and for allowing the beams and the foot supports to move for a greater distance than that of the links. The levers each includes an extension extendible downward, the pivot shafts are pivotally secured to the extensions for allowing the pivot shafts to be adjusted relative to the pivot pins. The cranks each includes a pulley rotatably secured thereon, the beams each includes a rear portion slidably engaged on the pulley for allowing the beams to be moved relative to the links.

The resistance force applying means includes a weight rotatably supported on the base, and means coupling the weight to the cranks for applying a resistance force against a rotational movement of the cranks. The weight includes a pulley, and a wheel is secured to the cranks and coupled to the pulley for allowing the weight to apply the resistance force against the rotational movement of the cranks.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
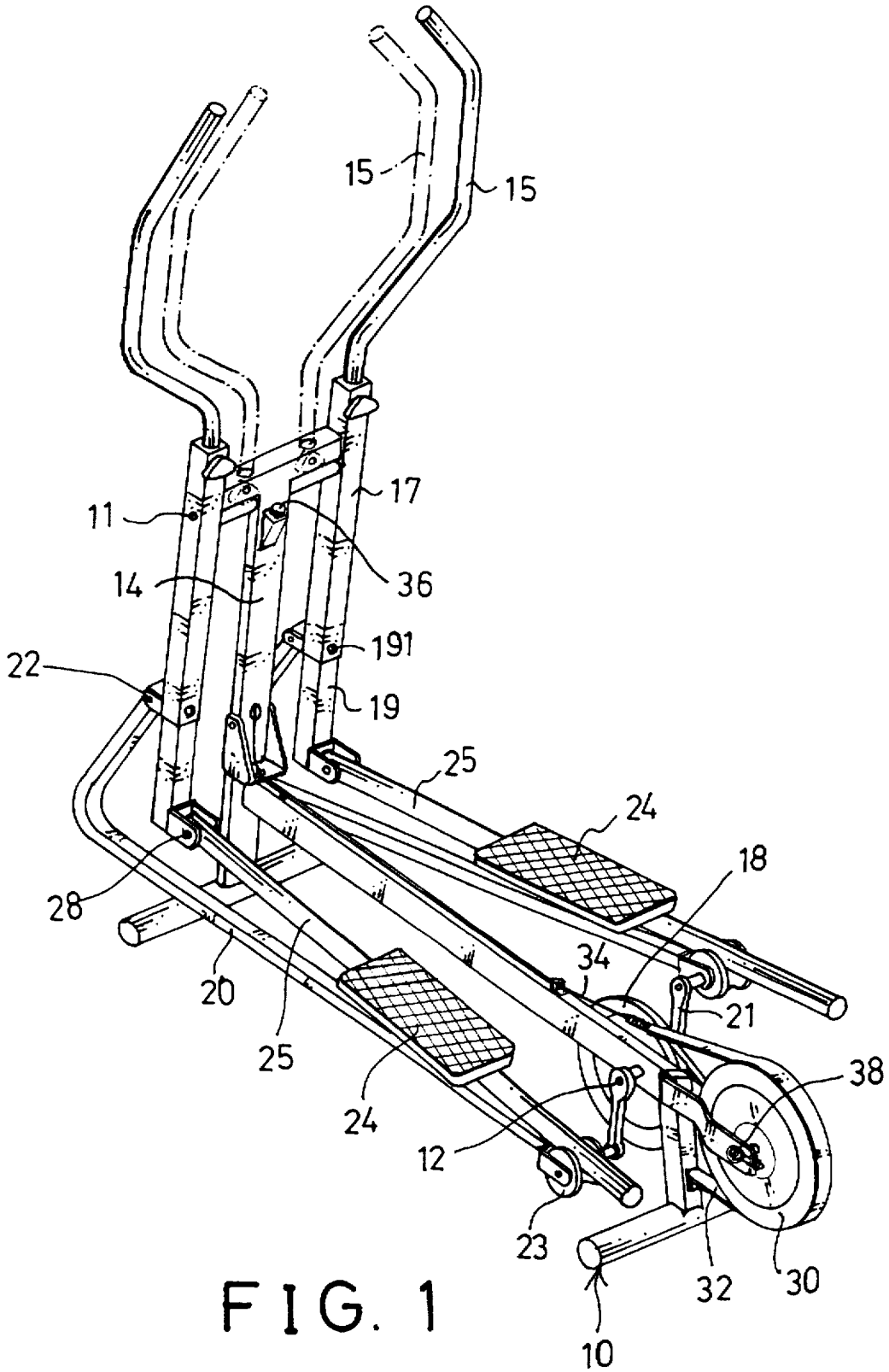
FIG. 1 is a perspective view of a stationary exerciser in accordance with the present invention.
Figure 2:
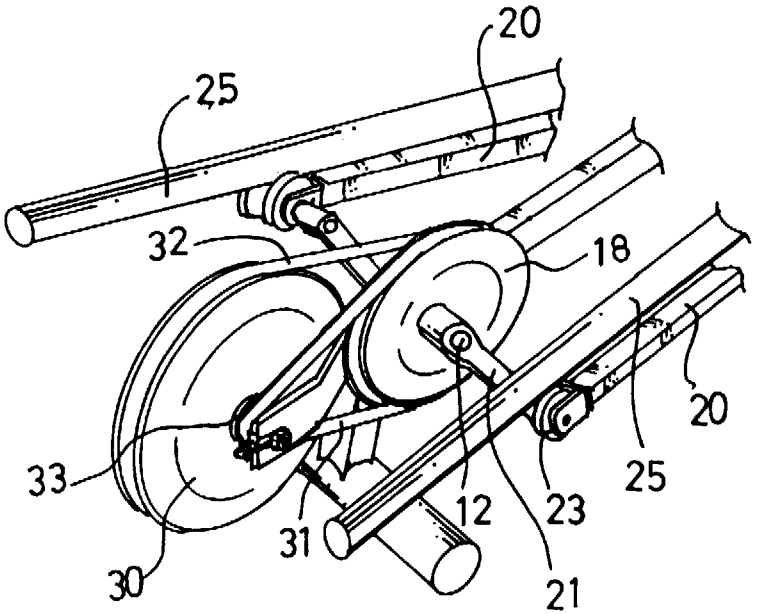
FIG. 2 is an enlarged partial perspective view of the stationary exerciser.
Figure 3:
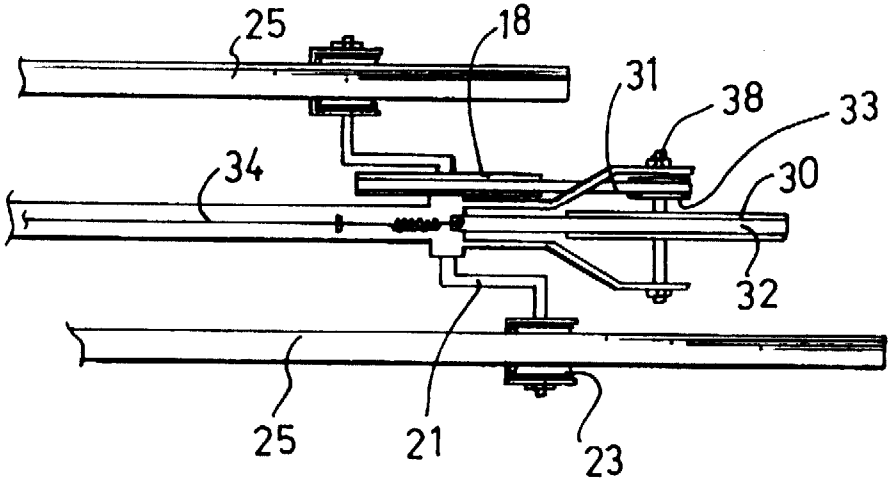
FIG. 3 is a partial top view of the exerciser.

Referring to the drawings, and initially to FIGS. 1–4, a stationary exerciser in accordance with the present invention comprises a base 10 including a front axle 11 and a rear axle 12, and including a post 14 extended upward from the front portion for supporting a pair of handles 15 which may be used for supporting the upper portion of the user. A pair of levers 17 include an upper portion pivotally secured to the front axle 11 for allowing the levers 17 to be rotated about the front axle 11 respectively. The handles 15 may also be secured on top of the levers 17 and swung in concert with the levers 17. A pair of cranks 21 are rotatably secured to the rear axle 12. A wheel 18 is secured to the cranks 21 and rotated in concert with the cranks 21. A weight 30 is rotatably supported on the base 10 at a pivot rod 38 and includes a pulley 33 coupled to the wheel 18 by a belt 31 for allowing the weight 30 to apply a resistance force against the rotational movement of the cranks 21. The cranks 21 each includes a pulley 23.

A pair of links 20 include a front portion pivotally secured to the middle portions of the levers 17 by pivot pins 22 and include a rear portion pivotally coupled to the cranks 21 for allowing the rear portions of the links 20 to be rotated in concert with and the cranks 21 and for allowing the front portions of the links 20 to be swung with the levers 17. The lower portions of the levers 17 each includes an extension 19 extendible relative to the levers 17 and secured to the levers 17 by fasteners 191. A pair of beams 25 each includes a front portion pivotally secured to the lever 17 or the extension 19 at a pivot shaft 28 and each includes a rear portion slidably engaged and supported on the pulleys 23 for allowing the rear portions of the links 20 to be rotated with and moved relative to the cranks 21. Alternatively, the pivot shafts 28 may be directly secured to the levers 17 without the extensions 19. A pair of foot supports 24 are secured on the beams 25 and moved in concert with the beams 25.

It is to be noted that the pivot pins 22 and the pivot shafts 28 move in concert with the levers 17 and rotate about the front axle 11. However, the pivot pins 22 are located closer to the front axle 11 than the pivot shafts 28, such that the swinging amplitude of the pivot shafts 28 is greater than that of the pivot pins 22 and such that the beams 25 move for a longer distance relative to the links 20. The adjustment of the pivot shafts 28 relative to the pivot pins 22 may adjust the relative movement between the beams 25 and the links 20. The relative movement between the foot supports 24 (which are supported on the beams 25) and the links 20 may thus be adjusted. The weight 30 may apply a resistance force against the rotational movement of the cranks 21 and against the movement of the foot supports 24.

Figure 5:
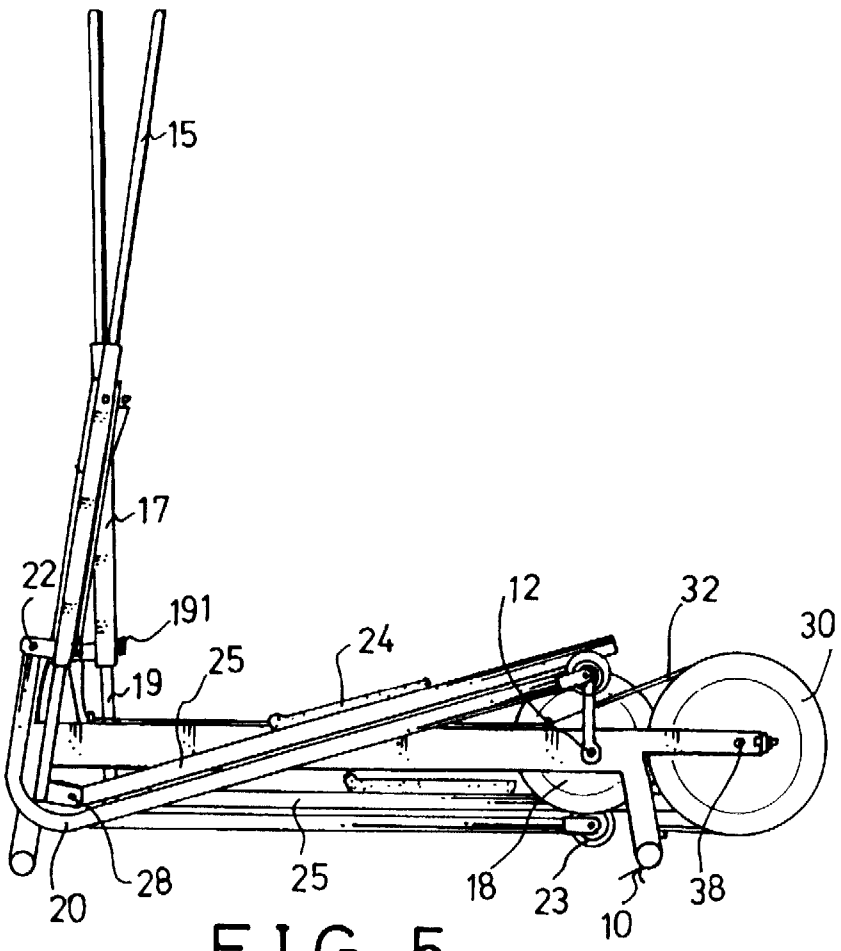
FIGS. 4 and 5 are side views illustrating the operation of the stationary exerciser.
Figure 4:
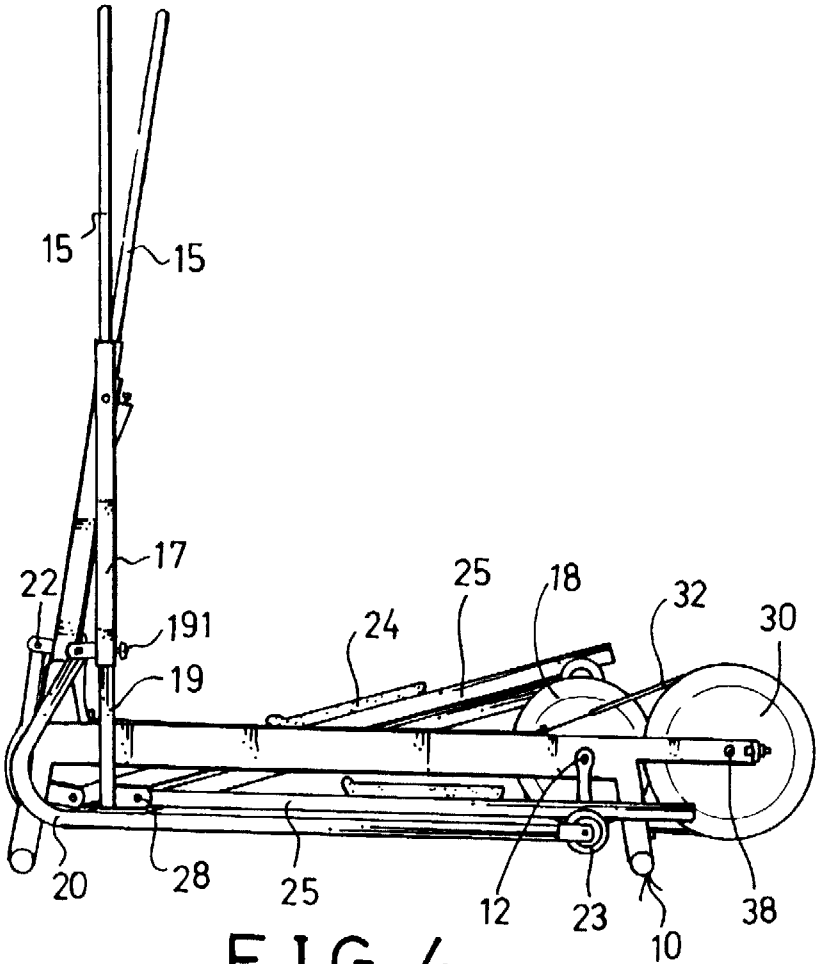

In operation, as shown in FIGS. 4 and 5, the rear ends of the links 20 and the cranks 21 may rotate about the rear axle 12, and the front ends of the links 20 may swing about the front axle 11, such that the links 20 may be moved along a substantially elliptical path. The beams 25 for supporting the foot supports 24 may be moved for a longer distance relative to the links 20 for forming an elliptical moving path other than that of the links 20. The slidable engagement between the rear portions of the beams 25 and the pulleys 23 allows the beams 25 to be relative to the cranks 21 which are rotated about the rear axle 12. The moving strokes of the foot supports 24 relative to the links 20 may be adjusted by adjusting the pivot shafts 28 relative pivot pins 22.

A belt 32 may further be provided and engaged around the weight 30 and is coupled to a knob 36 by a cable 34 for allowing the knob 36 to adjust different force against the weight 30.

Accordingly, the user may use the exerciser to conduct a stepping exercise along an elliptical moving path. A resistance force may apply a resistance force against the movement of the foot supports.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base including a rear axle and a front axle, a pair of levers pivotally coupled to said front axle for allowing said levers to be swung about said front axle, a pair of cranks rotatably secured to said rear axle a pair of links including a front portion pivotally secured to said levers and including a rear portion pivotally coupled to said cranks, a pair of foot supports supported beside said links, means for moving said foot supports relative to said links, and means for applying a resistance force against said foot supports.

2. An exerciser according to claim 1, wherein said levers each includes a middle portion and a lower portion, said front portions of said links each is pivotally secured to said middle portion of said lever at a pivot pin, said exerciser further includes a pair of beams each having a front portion pivotally secured to said lower portion of said lever at a pivot shaft, said foot supports are secured on said beams, said pivot pins are disposed between said front axle and said pivot shaft for allowing said pivot shafts to swing for a greater amplitude than that of said pivot pins and for allowing said beams and said foot supports to move for a greater distance than that of said links.

3. An exerciser according to claim 2, wherein said levers each includes an extension extendible downward, said pivot shafts are pivotally secured to said extensions for allowing said pivot shafts to be adjusted relative to said pivot pins.

4. An exerciser according to claim 2, wherein said cranks each includes a pulley rotatably secured thereon, said beams each includes a rear portion slidably engaged on said pulley for allowing said beams to be moved relative to said links.

5. An exerciser according to claim 1, wherein said resistance force applying means includes a weight rotatably supported on said base, and means coupling said weight to said cranks for applying a resistance force against a rotational movement of said cranks.

6. An exerciser according to claim 5, wherein said weight includes a pulley rotated in concert with said weight, said resistance force applying means includes a wheel secured to said cranks and rotated in concert with said cranks, and means coupling said wheel to said pulley for allowing said weight to apply the resistance force against the rotational movement of said cranks.

* * * * *